United States Patent [19]

Rush

[11] 4,101,877

[45] Jul. 18, 1978

[54] MAIL DELIVERY ALARM SYSTEM

[76] Inventor: Donald W. Rush, 633 Myrtle Rd., North Brunswick, N.J. 08902

[21] Appl. No.: 695,506

[22] Filed: Jun. 11, 1976

[51] Int. Cl.[2] ..... G08B 21/00
[52] U.S. Cl. ..... 340/569; 235/37
[58] Field of Search ..... 340/281, 384 E; 232/35, 232/36, 37

[56] References Cited

U.S. PATENT DOCUMENTS

| | | | |
|---|---|---|---|
| 2,463,957 | 3/1949 | Faulkenbury et al. | 340/281 |
| 2,535,607 | 12/1950 | Smith | 340/281 |
| 3,744,022 | 7/1973 | Olsen | 340/384E |
| 3,935,994 | 2/1976 | Darvishian | 340/281 |

OTHER PUBLICATIONS

Ryan, Ray, *Basic Digital Electronics,* Tab Books, Blue Ridge Summit, Pa., 1975, pp. 90–91.

*Primary Examiner*—Glen R. Swann, III
*Attorney, Agent, or Firm*—Beveridge, DeGrandi, Kline & Lunsford

[57] ABSTRACT

A system for activating a light and music box in the home when mail is deposited in a mail box located outside the home, and for deactivating the light and music box when the mail is removed. Switch means is provided inside the mail box and a circuit is arranged to activate the signal devices every other time the switch means is closed. Additionally, a signal light is provided on the mail box to enable a visitor to find the proper home at night, and an electrically operated lock is provided for the mail box to prevent the mail from being stolen.

1 Claim, 3 Drawing Figures

MAIL DELIVERY ALARM SYSTEM

BACKGROUND OF THE INVENTION

The present invention is directed to a system for activating a signal device or devices in the home when a letter carrier places mail in a mail box which is located outside the home.

Since in most localities letter carriers do not arrive at each home on their route at the same time each day, there is usually a great deal of uncertainty as to whether or not the letter carrier has arrived. This may result in the home occupant making several trips to the mail box before the letter carrier has arrived, and this may be particularly inconvenient when the mail box is located at a distance from the home, as it may be in rural areas, and in inclement weather. And, if the letter carrier has already arrived but there was no mail delivered that day, the trip to the mail box was for naught.

SUMMARY OF THE INVENTION

According to the present invention, a signal device or devices is or are provided in the home, and a circuit is provided for activating the devices when the letter carrier deposits mail in the mail box. When the occupant of the house removes the mail from the mail box, the signal devices are deactivated and are therefore readied for subsequent activation, which would ordinarily occur when the letter carrier delivers the mail on the next day.

In particular, according to one embodiment of the present invention, a light is used as a signal device in the home. According to a further embodiment a light is used in combination with a music box.

It is therefore an object of the invention to provide a system for automatically providing a signal indication in the home when the letter carrier deposits mail in a mail box outside the home.

It is a further object of the invention to provide a system which will activate a light and a music box in the home when the mail is deposited.

It is still a further object of the invention to provide a light on the mail box which may be activated by a switch in the home to better enable visitors to find the proper home at night.

It is still a further object of the invention to provide an automatic lock for the mail box which will prevent persons from stealing the mail after it has been delivered.

The above objects are accomplished by providing a switch inside the mail box, which switch is closed when the mail box door is closed and which is opened when the mail box door is opened. A circuit is provided for activating the signal device or devices every other time the switch is closed and for deactivating the signal device or devices at each time the switch is closed between the every other time.

BRIEF DESCRIPTION OF THE DRAWING

The invention will be better understood by referring to the accompanying Figures in which.

DESCRIPTION OF THE PREFERRED EMBODIMENT

Figure 1:
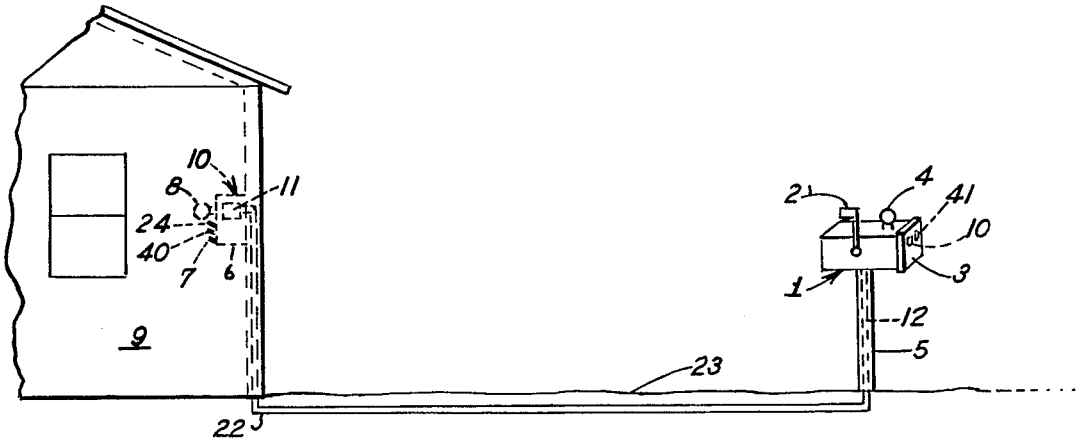
FIG. 1 is an overview of the system of the invention.

Referring to FIG. 1, house 9 and rural-type mail box 1, which is located outside of the house, are shown. As is known, in rural areas, the mail box may be located at a substantial distance from the house and it may be quite an annoyance to the residents of the house to have to make repeated trips to the mail box to determine whether or not the mail has been delivered. Further, while FIG. 1 is illustrated with regard to a rural type mail box, it should be noted that the invention is not limited thereto but can also be used with regular delivery type mail boxes such as are found in apartment houses.

Mail box 1 is supported by post 5, which may be hollow, and has flag 2 thereon. Additionally, mail box 1 has an openable and closeable door, 3, and further has light 4 disposed thereon. Conduit 22 which may house a number of conductors is run from the mail box 1 through hollow post 5 if desired, and to house 9. While the conduit is shown as being run under the ground 23 in the Figure, it may be run on top of the ground if desired.

Signal box 6 is located inside of house 9, for instance mounted on a wall, and has lamp 8 located thereon as well as toggle switches 7, 24 and 40. Further, signal box 6 has music box 11 located therein, and contains all of the circuitry necessary for operating the system of the invention. If desired, the light and/or music box may be wired to the signal box 6 but placed at a different location.

Mail box 1 has a switch means 10 disposed therein immediately adjacent the door 3. This switch means has an operating means which is moved by the opening and closing of door 3, the switch means being arranged so that the switch is closed when door 3 is closed and is opened when door 3 is opened. While no specific switch means is shown, a variety of switches, such as for instance an ordinary microswitch, may be used, and a choice of a specific switch as well as its exact placement are within the skill of those in the art.

Circuit means are provided which will activate light 8 and music box 11 at every other closing of the mail box door 3 and which will deactivate lamp 8 and music box 11 at the door closings between the every other closing. In this way, when the letter carrier closes door 3 after depositing the mail, the signal devices will be activated, and when the occupants of the house close the door 3 after removing the mail, the signal devices will be deactivated.

Figure 2:
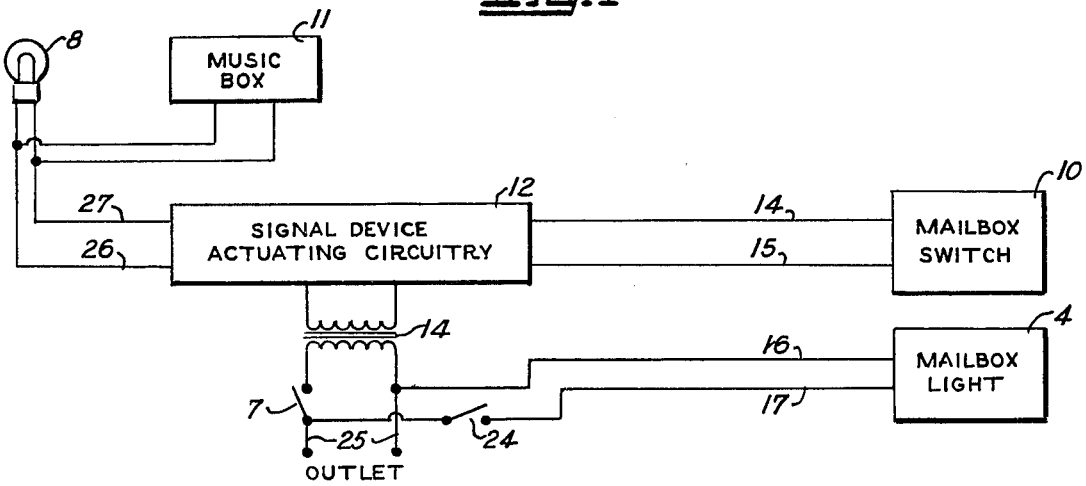
FIG. 2 is a block diagram of the circuit arrangement of the invention.

Circuitry for accomplishing the above functions is shown in block diagram form in FIG. 2. Mail box switch 10 is connected to signal device activating circuitry 12 through conductors 14 and 15. Conductors 25 are connected to the ordinary household A.C. outlet and the system is turned on by closing switch 7. This applies a voltage across the primary of step-down transformer 14, which provides a lower voltage across the output of a secondary winding thereof. Signal device activating circuitry 12 is effective to connect the secondary winding output of transformer 14 to conductors 26 and 27 to activate lamp 8 and music box 11 upon every other closing of switch 10. The design of such circuitry is within the skill of one in the art and a specific embodiment thereof is shown in FIG. 3.

Conductors 16 and 17 connect mail box light 4 to conductors 25 or alternatively to the low side of the transformer, through switch 24, which is turned on when it is desired to activate light 4. Light 4 is preferably red in color and is activated when a guest who is unfamiliar with the home is expected at night. The guest is informed to look for the house with the red light on the mail box, and finding the house hence becomes a relatively easy task.

Figure 3:
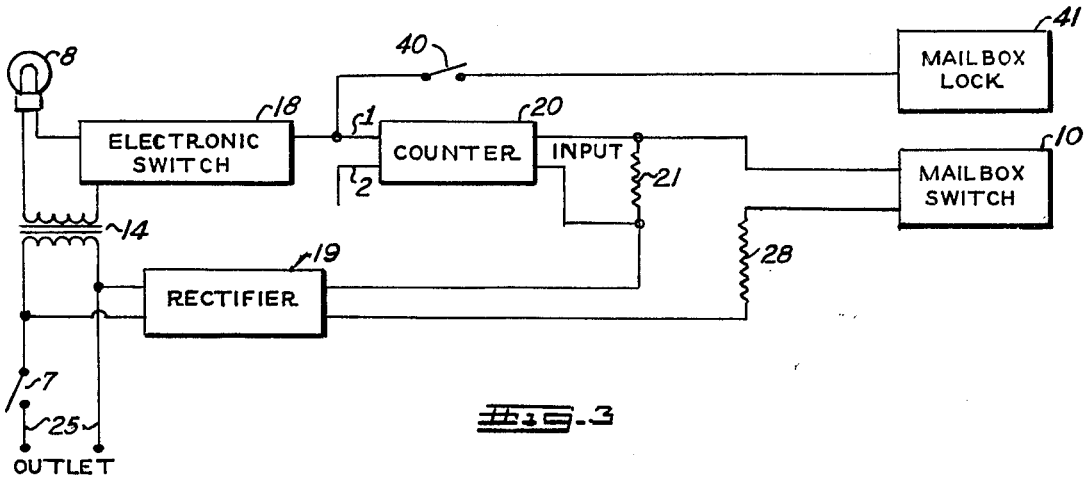
FIG. 3 is a more specific block diagram of the circuit arrangement of FIG. 2.

Referring to FIG. 3, conductors 25, or in the alternative, the output conductors of the secondary of transformer 14 are connected to rectifier 19 which provides a D.C. voltage output. Each time mail box switch 10 is closed current flows through resistor 28, the switch contacts of switch 10, and resistor 21. The output of resistor 21 is connected to the input of counter 20 which has two outputs denoted as 1 and 2 in FIG. 3. At the first switch closing, that is when the letter carrier closes the door of the mail box after depositing the mail, output 1 of counter 20 becomes activated and triggers electronic switch 18, which may be a transistor, SCR, unijunction transistor, etc. to close the circuit between the secondary of transformer 14 and the signal devices. The details of the circuit connections of electronic switch 18 are known to those skilled in the art. When mail box switch 10 is closed the second time, that is when the occupants of the house closes the mail box door after removing the mail, output 1 of counter 20 stops being activated and output 2 is activated. Deactivation of output 1 opens electronic switch 18 again and stops current flow to the signal devices, thereby deactivating them.

Electrically activated mail box lock 41 may also be provided to prevent the mail from being stolen after it has been deposited. This may be any electrically activated lock known to those skilled in the art, for instance, a magnetic lock wherein an electromagnet becomes activated to magnetically keep the mail box door closed. The specific installation of such a lock in the mail box is also known to those skilled in the art. In FIG. 3, output 1 of counter 20 is connected to mail box lock 41 through switch 40 to activate the lock after the mail has been deposited. If an electromagnet is used and high power is required to activate it, then output 1 of counter 20 could be arranged to activate an electronic switch which would turn on the high power circuit. After the signal devices have become activated and before going out to pick up the mail, switch 40 is manually opened to release the lock.

I have therefore disclosed a useful system to enable the home dweller to more efficiently pick up his mail, to provide the mail from being stolen, and to provide a signal at the mail box at night to enable visitors to find the right house.

Further, while I have described an illustrative embodiment of my invention, I wish it to be understood that I do not intend to be restricted solely thereto, but that I do intend to cover all modifications thereof which would be apparent to one skilled in the art and which come within the spirit and scope of my invention.

What is claimed is:

1. A system for activating at least one signal device located in a house when mail is deposited in a mailbox located outside the house and for deactivating the signal device when the mail is withdrawn from the mailbox, comprising:

a house having a signal device or a plurality of signal devices therein;

a mailbox located outside said house and having an openable and closeable door, switch means located in said mailbox behind said door, said switch means being closed when said door is closed and open when said door is open;

means for activating said signal device or plurality of devices every other time said switch means is closed and for deactivating said signal device at each time said switch means is closed between said every other time; and an electrically engagable lock means located in said mailbox for locking the mailbox door shut, said lock being engaged at said every other time said switch means is closed, and manually operated switch means for disengaging said lock means.

* * * * *